US005950433A

United States Patent [19]

Kalina

[11] Patent Number: 5,950,433

[45] **Date of Patent: *Sep. 14, 1999**

[54] METHOD AND SYSTEM OF CONVERTING THERMAL ENERGY INTO A USEFUL FORM

[75] Inventor: Alexander I. Kalina, Hillsborough, Calif.

[73] Assignee: Exergy, Inc., Hayward, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/731,095

[22] Filed: Oct. 9, 1996

[51] Int. Cl.[6] ..... F01K 25/06

[52] U.S. Cl. ..... 60/649; 60/653; 60/673

[58] Field of Search ..... 60/649, 673, 653

[56] References Cited

U.S. PATENT DOCUMENTS

| | | | |
|---|---|---|---|
| 4,346,561 | 8/1982 | Kalina . | |
| 4,489,563 | 12/1984 | Kalina . | |
| 4,548,043 | 10/1985 | Kalina . | |
| 4,586,340 | 5/1986 | Kalina . | |
| 4,604,867 | 8/1986 | Kalina . | |
| 4,732,005 | 3/1988 | Kalina . | |
| 4,763,480 | 8/1988 | Kalina . | |
| 4,899,545 | 2/1990 | Kalina . | |
| 4,982,568 | 1/1991 | Kalina . | |
| 5,029,444 | 7/1991 | Kalina . | |
| 5,095,708 | 3/1992 | Kalina . | |
| 5,440,882 | 8/1995 | Kalina . | |
| 5,450,821 | 9/1995 | Kalina . | |
| 5,572,871 | 11/1996 | Kalina | 60/649 |
| 5,588,298 | 12/1996 | Kalina et al. | 60/676 |
| 5,649,426 | 7/1997 | Kalina et al. | 60/649 |

*Primary Examiner*—Noah P. Kamen

*Attorney, Agent, or Firm*—Alan H. Gordon & Associates, P.C.

[57] ABSTRACT

A method of implementing a thermodynamic cycle by expanding a gaseous working stream to transform its energy into a useful form and produce an expanded gaseous stream, removing from the expanded gaseous stream an extracted stream, absorbing the extracted stream into a lean stream having a higher content of higher-boiling component than is contained in the extracted stream to form a combined extracted/lean stream, at least partially condensing the combined extracted/lean stream, combining at least part of the combined extracted/lean stream in condensed form with an oncoming working stream including a rich stream having a lower content of higher-boiling component than is contained in the extracted stream to provide a combined working stream, and heating the combined working stream with external heat to provide the gaseous working stream.

28 Claims, 3 Drawing Sheets

METHOD AND SYSTEM OF CONVERTING THERMAL ENERGY INTO A USEFUL FORM

BACKGROUND OF THE INVENTION

The invention relates to implementing a thermodynamic cycle to convert thermal energy into a useful form.

Conversion of high temperature heat (thermal energy) which is produced in a furnace into mechanical power and then electrical power in most thermal power plants is based on utilization of the Rankine Cycle. U.S. Pat. Nos. 4,899,545 and 4,732,005 describe thermodynamic cycle processes which are based on use of multi-component working fluids. These processes differ substantially from the Rankine Cycle, and provide higher efficiency. The system described in U.S. Pat. No. 4,899,545 employs a distillation tower, a component which is complicated and unusual for the power industry.

SUMMARY OF THE INVENTION

In one aspect, the invention features, in general, a method of and an apparatus for implementing a thermodynamic cycle. A gaseous working stream is expanded to transform its energy into a useful form and produce an expanded gaseous stream. An extracted stream is removed from the expanded gaseous stream and absorbed into a lean stream having a higher content of higher-boiling component than is contained in the extracted stream to form a combined extracted/lean stream. The combined extracted/lean stream is at least partially condensed. At least part of the combined extracted/lean stream in condensed form is added to an oncoming working stream including a rich stream having a lower content of higher-boiling component than is contained in the extracted stream. The oncoming working stream is then recuperatively heated with heat released in the condensation of the combined extracted/lean stream prior to forming the gaseous working stream that is then expanded.

Certain implementations of the invention may include one or more of the following features. In certain implementations the oncoming working stream is heated with external heat after being recuperatively heated to provide the gaseous working stream. At least part of the combined extracted/lean stream in condensed form is heated by external heat to a vapor state prior to being added to the oncoming working stream, and the oncoming working stream is in a vapor state when combined. At least part of the combined extracted/lean stream in condensed form and the oncoming working stream are in liquid states when the former is added to the latter. A first part of the combined extracted/lean stream is added in liquid state, and a second part of the combined extracted/lean stream is heated to a vapor state and added to the oncoming working stream in a vapor state. The remainder of the expanded gaseous stream (beyond the extracted stream) can be subjected to one or more reheatings and further expansions to obtain further useful work. The lean stream and rich stream are produced from the spent stream. The extracted stream is cooled before absorbing into the lean stream by transferring heat to the oncoming working stream prior to heating the oncoming working stream with external heat. The combined extracted/lean stream is separated into a liquid component and a vapor component after being partially condensed and before being added to the oncoming working stream. The vapor component is condensed by transferring heat to the oncoming working stream to produce a condensed vapor component, which is then added to the oncoming working stream. At least part of the liquid component is heated by heat transfer from partial condensing of the combined extracted/lean stream. Part of the liquid component is added to the oncoming working stream as a liquid, and part of the liquid component is converted to a vapor and added to the oncoming working stream as a vapor. The oncoming stream is converted into a vapor by transferring heat from the combined extracted/lean stream. Heat from the remainder of the expanded gaseous stream is used to recuperatively heat the oncoming working stream and the lean stream. Heat from the extracted stream is used to recuperatively heat the oncoming working stream.

In another aspect, the invention features, in general, a different method of and apparatus for implementing a thermodynamic cycle. A gaseous working stream is expanded to transform its energy into a useful form and produce a spent stream. The spent stream is separated into a lean stream having a higher content of higher-boiling component than is contained in the spent stream and a remainder spent stream. A makeup stream is added to the remainder spent stream to produce a combined makeup/remainder spent stream, which is then condensed to produce a condensed remainder spent stream. The condensed remainder spent stream is separated into a rich stream and the makeup stream, the rich stream having a lower content of higher-boiling component than is contained in the spent stream, the makeup stream having a higher content of higher-boiling component than the rich stream.

Certain implementations of the invention may have one or more of the following features. The spent stream is partially condensed into liquid and vapor components, which are then separated, the vapor component being the remainder spent stream. The liquid component is partially boiled and separated into the lean stream in liquid form and a vapor stream that is added to the spent stream prior to the initial partial condensation step.

A second makeup stream is also extracted from the condensed remainder stream and added to the combined makeup/remainder stream. The condensed remainder stream is split into first and second streams; the first stream is recuperatively heated to partially boil it; thereafter a liquid component is separated from the first stream to provide the second makeup stream. A vapor component separated from the first stream is added to the second stream; the second stream is recuperatively heated to partially boil it; thereafter a second stream liquid component is separated from the second stream, and used to provide the first makeup stream. The second stream liquid component is recuperatively heated to partially boil it; thereafter a further liquid component is separated from the second stream liquid component and used to provide the first makeup stream. Vapors separated from the second stream liquid component and the further liquid component are combined to provide the rich stream.

Embodiments of the invention may have one or more of the following advantages. High efficiency is provided in a thermodynamic cycle for converting heat produced in a furnace to mechanical and electrical energy without the need for a distillation tower. Combining the lean stream with the extracted stream reduces the composition of the extracted stream, making it leaner and causing it to condense in a temperature range high enough to heat the rich portion of the oncoming working stream. Because the extracted stream is added to the oncoming working stream and returned in a loop to the high pressure turbine, there is less rejection of heat to outside of the system and improved efficiency. The rich stream is converted into a vapor at high pressure by recuperation of heat released in condensation of the extracted stream. Part of the combined extracted/lean stream is heated, after its complete condensation, recuperatively, by using heat released in the process of condensation of the same stream. In the distillation condensation subsystem the spent stream is condensed at a pressure which is lower than the pressure at which it could be condensed directly by available cooling media, and the spent stream is split and condensed into a very lean liquid and a very rich liquid.

Other advantages and features of the invention will be apparent from the following description of a preferred embodiment thereof and from the claims.

DESCRIPTION OF THE PREFERRED EMBODIMENTS

Figure 1:
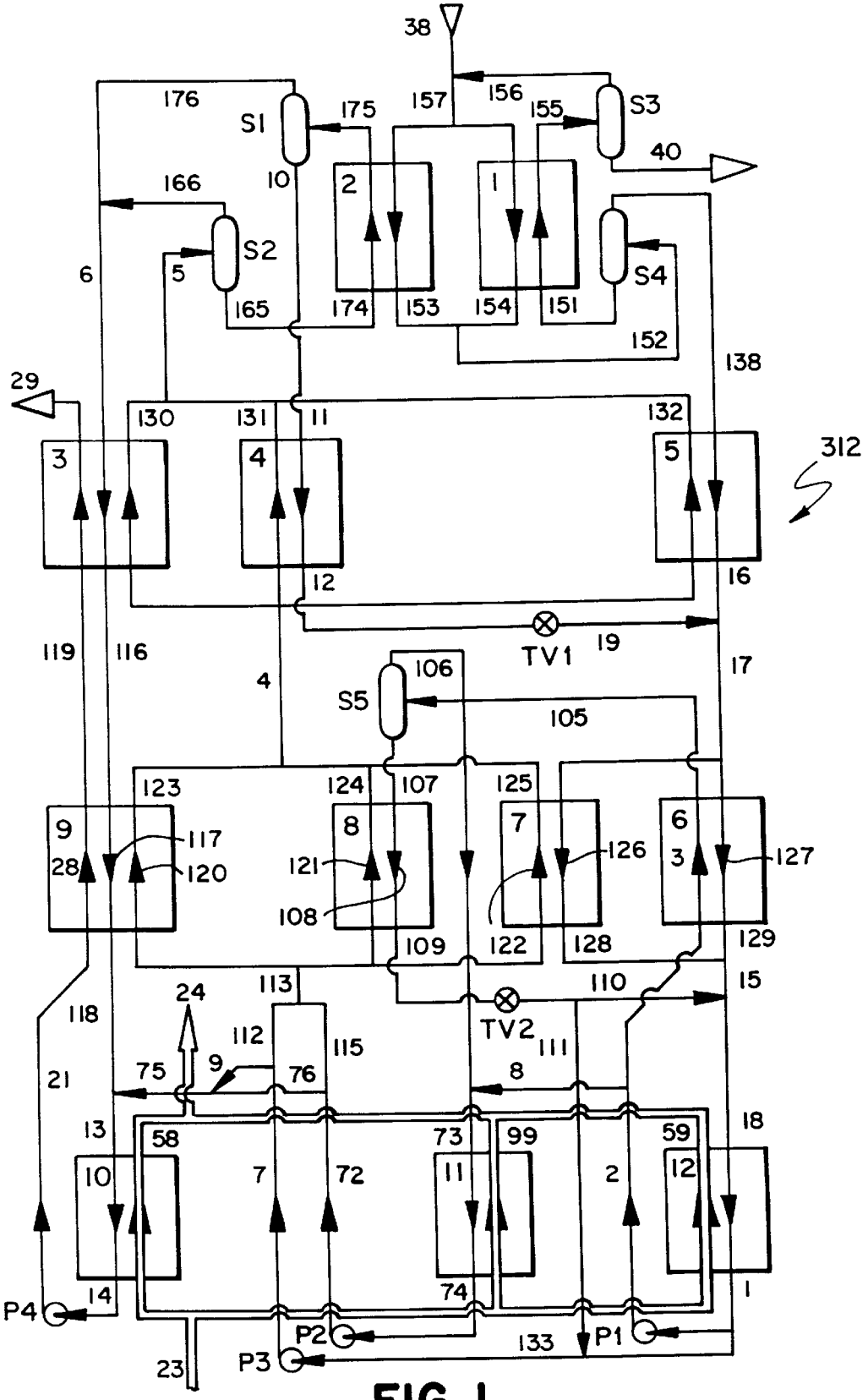
FIG. 1 is a diagram of a distillation condensation subsystem.
Figure 2:
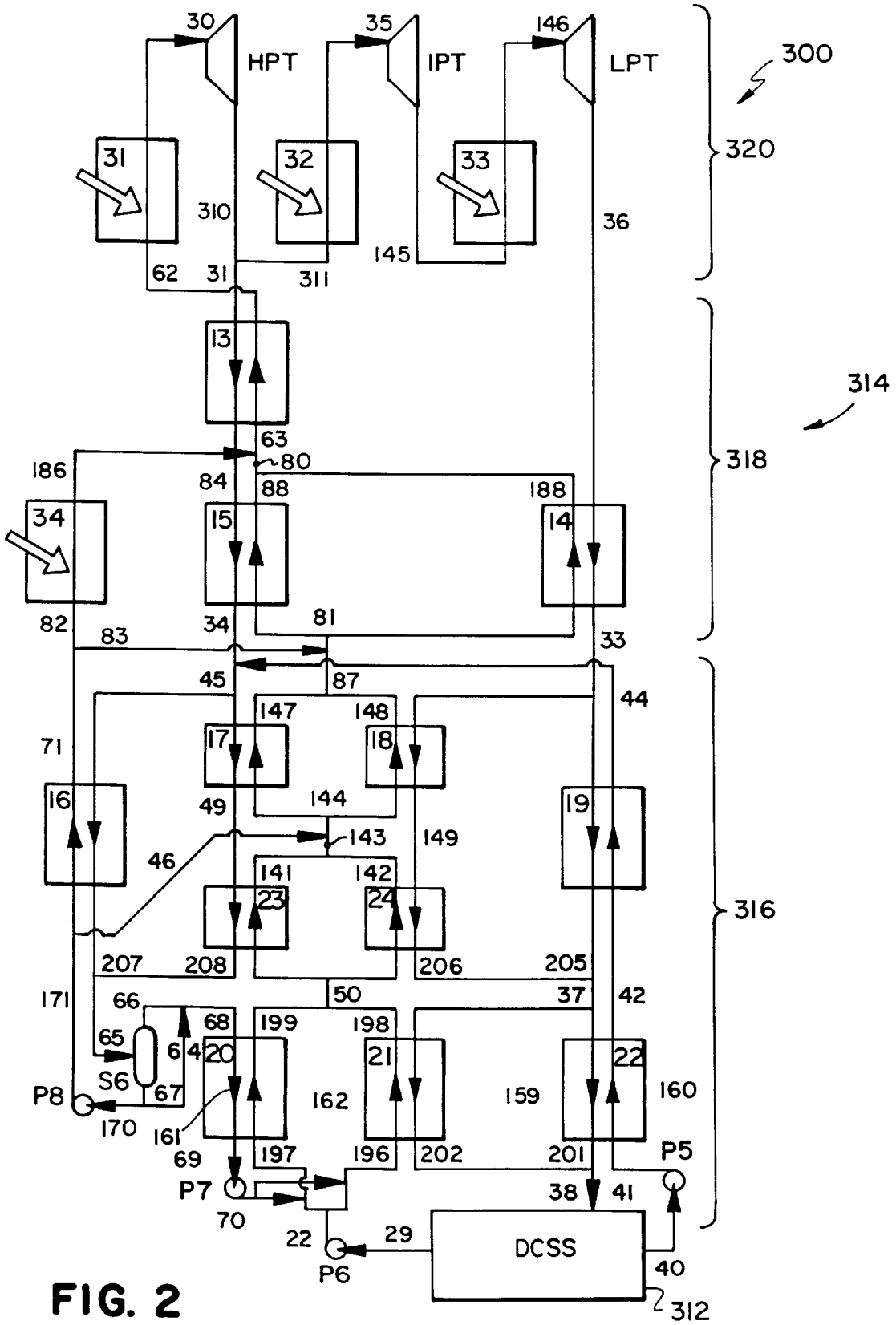
FIG. 2 is a diagram of apparatus for implementing a thermodynamic cycle including the FIG. 1 subsystem and a heat recuperation, heat acquisition and turbine expansion subsystem.

Referring to FIGS. 1 and 2, system 300 for implementing a thermodynamic cycle includes distillation condensation subsystem (DCSS) 312 shown on FIG. 1 and heat recuperation, heat acquisition and turbine expansion subsystem 314 shown on FIG. 2 along with DCSS 312. Subsystem 314 is further broken down into boiling condensing heat recuperation subsystem 316, furnace boiling and vapor heat recuperation subsystem 318, and superheating heat acquisition and turbine expansion subsystem 320.

Boiling condensing heat recuperation subsystem 316 includes recuperative heat exchangers HE-16, HE-17, HE-18, HE-19, HE-20, HE-21, HE-22, HE-23 and HE-24. (Note that the "HE" designations do not appear on the drawings.) It also includes gravity separator S-6, feed pump P6, and pumps P5, P7 and P8.

Furnace boiling and vapor heat recuperation subsystem 318 includes furnace heat exchanger HE-34 and recuperative heat exchangers HE-13, HE-14 and HE-15.

Superheating heat acquisition and turbine expansion subsystem 320 includes superheater heat exchangers HE-31, HE-32, and HE-33 and turbines: high pressure turbine (HPT), intermediate pressure turbine (IPT) and low pressure turbine (LPT).

System 300 utilizes as a working fluid a mixture of at least two components. Suitable mixtures include water-ammonia, water-carbon dioxide, and others. The following description is based on using a water-ammonia mixture as a working fluid; this is the same working fluid as described in the above-referenced patents. DCSS 312 is described in detail first, with reference to FIG. 1 and Table 1, which sets forth the conditions of the streams at indicated points in the flow diagram.

Distillation Condensation Subsystem 312

The spent working fluid enters DCSS 312 (see FIGS. 1 and 2) fully expanded and cooled to parameters corresponding to a state of dry saturated vapor having parameters as at point 38. Referring to FIG. 1, a stream of saturated vapor, having parameters as at point 156 (see below), is mixed with the spent stream having parameters as at point 38 and creates a stream of vapor having parameters as at point 157. Thereafter the stream of vapor, having parameters as at point 157, is divided into two substreams which pass through heat exchangers HE-1 and HE-2, where they are cooled and partially condensed and obtain parameters as at points 154 and 153, correspondingly. Thereafter streams, having parameters as at points 153 and 154, are combined, creating a stream with parameters as at point 152 which is sent into gravity separator S-4. In gravity separator S-4, the liquid is separated from the vapor. The stream of liquid from gravity separator S-4, having parameters as at point 151, is sent, in counterflow, to stream 157–154 into heat exchanger HE-1 (see above) where this stream is partially boiled. This stream leaves heat exchanger HE-1, having parameters as at point 155, and then enters gravity separator S-3. In gravity separator S-3, vapor is separated from the liquid, and this vapor, having parameters as at point 156, is mixed with the entering spent stream, having parameters as at point 38, creating a stream of vapor with parameters as at point 157 (see above). Liquid separated in gravity separator S-3, having parameters as at point 40, leaves DCSS 312 and is sent into boiling condensing heat recuperation subsystem 316 (FIG. 2; see below). This stream, at point 40, is referred to as the lean stream and has a higher content of higher-boiling component (water) than is contained in the entering spent stream, at point 38.

Vapor separated in gravity separator S-4 (see above) is in a state of dry saturated vapor. This stream of vapor, having parameters as at point 138 and referred to as the remainder spent stream, passes through heat exchanger HE-5 where it is cooled and partially condensed and obtains parameters as at point 16. Thereafter the remainder spent stream, having parameters as at point 16, is mixed with the stream of liquid, having parameters as at point 19 and referred to as a first makeup stream, and as a result a new stream of partially condensed working fluid, having parameters as at point 17, is created. The resulting stream is referred to as a combined makeup/remainder spent stream. In a preferred embodiment, liquid having parameters as at point 19 is at thermodynamic equilibrium to the stream having parameters as at point 16 and, as a result of such equilibrium, the temperatures and pressures at points 16, 19 and 17 are equal. Thereafter, the combined makeup/remainder spent stream, having parameters as at point 17, is divided into two substreams, which pass through heat exchangers HE-6 and HE-7, obtaining parameters as at points 129 and 128, correspondingly, before recombining. In these two heat exchangers, the substreams having parameters as at point 17 are further cooled and condensed and release heat. The substreams have the parameters as at points 128 and 129, and the combined makeup/remainder spent stream then has parameters as at point 15. Then the liquid having parameters as at point 110 and referred to as a second makeup stream is added to the combined makeup/remainder spent stream, having parameters as at point 15, resulting in the combined makeup/remainder stream having the parameters as at point 18. As a result of this mixing, the composition of the stream at point 18 is leaner than the composition of a stream at point 15; i.e., it has a higher content of water than the stream having parameters as at point 15. Thereafter the stream, having parameters as at point 18, passes through the low pressure condenser HE-12, where it is fully condensed and obtains parameters as at point 1. This stream (at point 1) is referred to as the condensed remainder stream. The heat of condensation is removed by a stream of cooling media (water or air) which enters heat exchanger HE-12, with parameters as at point 23, and exits this heat exchanger having parameters as at point 59.

It is noted that the remainder stream, having compositions as at point 138 and 16, and the initial combined makeup/ remainder spent stream, having the composition as at points 17 and 15, cannot be fully condensed at the pressure and temperature corresponding to point 1. Only after final mixing with the second makeup stream, having parameters as at point 110, can the final combined makeup/remainder spent stream, having parameters as at point 18, obtain a composition which allows the remainder stream to be fully condensed as at point 1.

The condensed remainder stream, having parameters as at point 1, is then divided into two substreams. One of these substreams enters circulating pump P1 and is pumped to an elevated pressure and obtains parameters as at point 2. Thereafter, a stream of liquid having parameters as at point 2 is divided into two substreams. One of these streams then passes, in counterflow, to stream 17–129 through heat exchanger HE-6 (see above). This substream passing through heat exchanger HE-6, is first heated and obtains parameters as at point 3 corresponding to a state of saturated liquid and, thereafter, is partially vaporized and obtains parameters as at point 105. The other substream, on which a stream having parameters as at point 2 has been divided, has parameters as at point 8. The partially boiled stream, having parameters as at point 105, then enters into gravity separator S-5, where it is separated into vapor, having parameters as at point 106, and liquid, having parameters as at point 107. The stream of vapor, having parameters as at point 106, is then mixed with the stream of liquid, having parameters as at point 8, creating a stream which has parameters as at point 73. The stream, having parameters as at point 73, enters into intermediate pressure condenser HE-11, where it is cooled and fully condensed, exiting this heat exchanger having parameters as at point 74. Cooling is provided by a cooling medium, having initial parameters as at point 23, which passes through heat exchanger HE-11 in counterflow to the stream 73–74 and obtains the exit parameters as at point 99. The stream of liquid from gravity separator S-5, having parameters as at point 107, passes through heat exchanger HE-8, where it is cooled and obtains parameters as at point 109. Thereafter the stream of liquid, having parameters as at point 109, passes through throttle valve TV-2, where its pressure is reduced and then it is divided into two substreams, having parameters as at points 110 and 111, correspondingly. The stream, having parameters as at point 110, which represent the bulk of the stream with parameters as at point 109, after being throttled, is the second makeup stream that is then mixed with the initial combined makeup/remainder stream, having parameters as at point 15, creating the final combined makeup/remainder stream with parameters as at point 18 (see above).

The fully condensed stream, having parameters as at point 74, is pumped to a high pressure of condensation by circulating pump P2 and obtains parameters as at point 72. Thereafter the stream of liquid, having parameters as at point 72, is divided into two substreams having parameters as at points 76 and 115, correspondingly. Part of the condensed remainder stream, having parameters as at point 1 (see above), is mixed with the stream having parameters as at point 111 and creates a stream of liquid, having parameters as at point 133. Thereafter the stream, having parameters as at point 133, enters circulating pump P-3, where it is pumped to a high pressure of condensation and obtains parameters as at point 7. Thereafter the stream of liquid, having parameters as at point 7, is divided into two substreams having parameters as at points 9 and 112, correspondingly. Thereafter the streams, having parameters as at points 76 and 9, are mixed, creating a stream having parameters as at point 75. The streams, having parameters as at points 115 and 112, are used to create a stream with parameters as at point 113 by mixing them. If it is required that the composition of a stream, having parameters as at point 113, be leaner than the composition of a stream having parameters as at point 1, then the stream with parameters as at point 113 is created by the mixing of streams, having parameters as at points 1 and 111 (see above). The flow rate of a stream, having parameters as at point 115, in such a case is equal to zero. If it is required that the composition of a stream, having parameters as at point 113, be richer than the composition of a stream having parameters as at point 1, then in such a case a stream having parameters as at point 113 is created by mixing streams with parameters as at points 115 and 112, and the flow rate of the stream, having parameters as at point 111, is equal to zero. As one can see, the stream with parameters as at point 113 is created by mixing the stream, having parameters as at point 1, either with the stream having parameters as at point 115 or with the stream having parameters as at point 111, but not with both of these streams.

Thereafter the stream, having parameters as at point 113, is divided into three substreams which pass through heat exchangers HE-7, HE-8, and HE-9. These streams are heated in these heat exchangers and obtain parameters as at points 125, 124 and 123, correspondingly. Thereafter, these three streams are combined and create a stream with parameters as at point 4. The stream, having parameters as at point 4, has a temperature which is slightly lower than the temperature of a stream, having parameters as at point 16 (see above). Because the composition of the stream, having parameters as at point 4, has been prepared by mixing streams having composition as at points 115 and 1, or by mixing streams having composition as at points 1 and 111 (see above), it is prepared in such a way that the stream, having parameters as at point 4, is in a state of saturated liquid or is very close to such a state. The streams are thus mixed to obtain the necessary composition of the stream, having parameters as at point 4. The stream, having parameters as at point 4, is divided into three substreams which are sent into heat exchangers HE-5, HE-4, and HE-3, where these streams are heated and partially boiled, obtaining parameters as at points 132, 131, and 130, correspondingly. Thereafter, these three substreams are combined again to create a stream, having parameters as at point 5. The stream having parameters as at point 5 then enters into gravity separator S-2, where it is separated into saturated vapor, having parameters as at point 166, and saturated liquid, having parameters as at point 165. The stream, having parameters as at point 165, is then transported to heat exchanger HE-2 (see above) and obtains parameters as at point 174. Thereafter the stream, having parameters as at point 174, passes through heat exchanger HE-2, where it is heated and partially boiled by heat released in the process of partial condensation of streams 157–153 (see above) and obtains parameters as at point 175. The stream, having parameters as at point 175, is sent into gravity separator S-1, where it is separated onto saturated vapor, having parameters as at point 176, and saturated liquid, having parameters as at point 10. The saturated liquid having parameters as at point 10 passes through heat exchanger HE-4, where it is cooled and provides heat for a process 4–131 (see above) and obtains parameters as at point 12. The cooled liquid, having parameters as at point 12, passes through throttle valve TV-1 where its pressure is reduced and obtains parameters as at point 19. This stream, referred to as the first makeup stream and having parameters as at point 19, is then mixed with the remainder spent stream, having parameters as at point 16, creating the initial combined makeup/ remainder spent stream having parameters as at point 17 (see above). The stream of vapor from gravity separator S-1, having parameters as at point 176, is mixed with the stream of vapor from gravity separator S-2, having parameters as at point 166 (see above), and as a result of such mixing the stream of vapor, having parameters as at point 6, is created. Vapor, having parameters as at point 6, is so-called rich vapor which has a very high content of ammonia. The stream of vapor, having parameters as at point 6, passes through heat exchanger HE-3, where it is cooled and partially condensed, releasing heat and obtaining parameters as at point 116. Thereafter the stream, having parameters as at point 116, passes through heat exchanger HE-9, where it is further cooled and condensed, releasing heat and obtaining parameters as at point 118. Thereafter the stream, having parameters as at point 118, is mixed with the stream, having parameters as at point 75 (see above), creating a rich stream having parameters as at point 13. The rich stream, having parameters as at point 13, passes through high pressure condenser HE-10, where it is fully condensed by a cooling media (process 23–58) and exits heat exchanger HE-10 with parameters as at point 14. Thereafter the rich stream of liquid, having parameters as at point 14, is pumped by feed pump P-4 to a desired high pressure obtaining parameters as at point 21. Then the rich stream, having parameters as at point 21, passes through heat exchanger HE-9, where it is heated and obtains parameters as at point 119. Thereafter the stream, having parameters as at point 119, passes through heat exchanger HE-3, where it is further heated and obtains parameters as at point 29. Thereafter the rich stream, having parameters as at point 29, leaves DCSS 312 and enters into boiling condensing heat recuperation subsystem 316.

DCSS 312 achieves two goals: a) a stream of vapor, having parameters as at point 138, is condensed at a pressure which is lower than the pressure at which it could be condensed directly by available cooling media, and b) the spent stream, having parameters as at point 38, is split into two substreams of a condensate; i.e., the lean stream having parameters as at point 40, which is a very lean liquid (see above), and the rich stream having parameters as at point 29, which is a very rich liquid. If the streams having parameters as at points 40 and 29 would be mixed, the resulting stream would have weight, flow rate and composition of the spent stream having parameters as at point 38.

Boiling-Condensing Heat Recuperation Subsystem 316, Furnace Boiling Vapor Heat Recuperation Subsystem 318, and Super-heating Heat Acquisition-Turbine Expansion Subsystem 320

Referring to FIG. 2, the rich stream with parameters as at point 29 and the lean stream with parameters as at point 40 enter the boiling-condensing heat recuperation subsystem 316 from DCSS 312. The rich stream from DCSS 312 forms the basis of the oncoming working stream, which is supplemented with various other streams, split into substreams that are recombined, and heated recuperatively and with external heat in its travel to high pressure turbine HPT, as is discussed in detail below. The oncoming working stream, having parameters as at point 29, enters into feed pump P-6, where it is pumped to the necessary high pressure and obtains parameters as at point 22. Thereafter the oncoming working stream, having parameters as at point 22, is divided into two substreams and is mixed with the stream of liquid having parameters as at point 70. The stream at point 70 includes a condensed richer vapor-liquid fraction that has been separated from a combined extracted/lean stream, as is discussed below. Because the composition of the stream at point 70 is different from the composition of the oncoming working stream at point 22, it is possible to create two substreams having different compositions which have parameters at points 196 and 197, correspondingly. Thereafter streams, having compositions as at points 196 and 197, are passed through heat exchangers HE-21 and HE-20, respectively, where they are heated and obtain parameters as at points 198 and 199, correspondingly. Thereafter substreams, having parameters as at points 198 and 199, are combined, and the resulting recombined oncoming working stream, with parameters as at point 50, has a pressure that exceeds critical pressure for the composition of this stream. The oncoming working stream, with parameters as at point 50, is divided into two substreams which pass through heat exchangers HE-23 and HE-24, where they are heated and obtain parameters as at points 141 and 142, correspondingly. The stream, with parameters as at point 50, is in a state of subcooled liquid, whereas streams, with parameters as at points 141 and 142, are in a state of superheated vapor. Thereafter streams, with parameters as at points 141 and 142, are combined, and the oncoming working stream now has parameters as at point 143. The oncoming working stream, with parameters, as at point 143 is mixed with the stream of subcooled liquid having parameters as at point 46 and obtains parameters as at point 144; the liquid at point 46 is part of a liquid component separated from a combined extracted/lean stream, as is discussed below. In the preferred embodiment of the proposed system, mixing of streams, having parameters as at points 143 and 46, is performed in such a way that the resulting oncoming working stream, with parameters as at point 144, has a temperature which is either equal or very close to a temperature of the stream with parameters as at point 143. Thereafter the oncoming working stream, with parameters as at point 144, is divided into two substreams which are passed through heat exchangers HE-17 and HE-18 and obtain parameters as at points 147 and 148, correspondingly. Thereafter streams, with parameters as at points 147 and 148, are combined, and the resulting oncoming working stream now has parameters as at point 87. If necessary, an additional stream having parameters as at point 83 may be added to the oncoming working stream having parameters as at point 87, resulting in the oncoming working stream having parameters as at point 81. In the preferred embodiment, composition as at point 144 is chosen in such a way that the stream with parameters as at point 144 is in a state of saturated vapor or is close to this state. A stream, with parameters as at point 81, may be in a state of saturated vapor or in a state of vapor-liquid mixture (if a stream with parameters as at point 83 is added). Thereafter the oncoming working stream, with parameters as at point 81, is divided into two substreams which pass through heat exchangers HE-14 and HE-15, where those streams are heated, obtaining parameters as at points 188 and 88, correspondingly. Thereafter streams, having parameters as at points 188 and 88, are combined, resulting in the oncoming working stream having parameters as at point 80. The oncoming working stream, with parameters as at point 80, is then mixed with a stream of vapor, having parameters as at point 186, which comes from boiler HE-34; the stream of vapor at point 186 is part of a liquid component separated from a combined extracted/lean stream, which part has been vaporized at boiler HE-34, as is discussed below. After mixing, the oncoming working stream is in vapor form with parameters as at point 63. The oncoming working stream, with parameters as at point 63, passes through recuperative heat exchanger HE-13, where it is heated and obtains parameters as at point 62. Thereafter the oncoming working stream, with parameters as at point 62, passes through superheater HE-31, where it is further heated by heat from a furnace and obtains parameters as at point 30. The stream, with parameters as at point 30, is referred to as the gaseous working stream and is passed through the high pressure turbine (HPT), where it expands, producing power and exiting this turbine as an expanded gaseous stream with parameters as at point 310. Thereafter, the expanded gaseous stream exiting the HPT and having parameters as at point 310 is divided into an extracted stream having parameters as at point 31 and a remainder expanded gaseous stream having parameters as at point 311. The remainder expanded gaseous stream, with parameters as at point 311 is equal to the weight flow rate of the spent stream, with parameters as at point 38. This stream is the subject of further expansion and heat recuperation (see below). The extracted stream, with parameters as at point 31, is used to provide heat by way of recuperation for heating the oncoming working stream having initial high pressure. The extracted stream passes through heat exchanger HE-13 in counterflow to stream 63–62 (see above), where it is cooled providing heat for process 63–62 and obtains parameters as at point 84. Thereafter the extracted stream, with parameters as at point 84, passes through heat exchanger HE-15, where it is further cooled providing heat for process 81–88 and obtains parameters as at point 34.

The lean stream, with parameters as at point 40 entering the boiling condensing heat recuperation subsystem 316, enters circulating pump P-5, where it is pumped to a pressure approximately equal to the pressure of the extracted stream and obtains parameters as at point 41. The lean stream, with parameters as at point 41, passes through heat exchanger HE-22, where it is heated and obtains parameters as at point 42. Thereafter the lean stream, with parameters as at point 42, passes through heat exchanger HE-19, where it is further heated and obtains parameters as at point 44. The lean stream, with parameters as at point 44, is in a state of subcooled liquid. At the same time the extracted stream, with parameters as at point 34, is usually in a state of superheated vapor. The extracted stream and the lean stream, with parameters as at points 34 and 43, respectively, are mixed creating the combined extracted/lean stream, with parameters as at point 45, which is in a state of vapor-liquid mixture. The combined extracted/lean stream, with parameters as at point 45, is divided into two substreams. One substream passes through heat exchanger HE-17, where it is cooled and partially condensed, providing heat for process 144–147 (see above) and obtains parameters as at point 49. Thereafter the stream, with parameters as at point 49, passes through heat exchanger HE-23 where it is further cooled and condensed providing heat for process 50–141 (see above) and obtains parameters as at point 208. The second substream into which the combined extracted/lean stream with parameters as at point 45 has been divided passes through heat exchanger HE-16, where it is cooled and partially condensed and obtains parameters as at point 207. Thereafter streams, with parameters as at points 208 and 207, are combined resulting in the combined extracted/lean stream being a partially condensed mixture with parameters as at point 65. The combined extracted/lean stream, with parameters as at point 65, enters into gravity separator S-6, where it is separated into a saturated vapor component, having parameters as at point 66, and a saturated liquid component, having parameters as at point 67. The saturated liquid component, having parameters as at point 67, is divided into two substreams, having parameters as at points 64 and 170. The stream, with parameters as at point 64, is mixed with the vapor component, having parameters as at point 66, creating a richer vapor-liquid fraction stream having parameters as at point 68. The richer vapor-liquid fraction stream, with parameters as at point 68, passes through heat exchanger HE-20, where it is finally fully condensed, providing heat for process 197–199 (see above), and obtains parameters as at point 69. The stream, with parameters as at point 69, then enters circulating pump P-7, where its pressure is increased and it obtains parameters as at point 70. Thereafter the stream, with parameters as at point 70, is mixed with the oncoming working stream having parameters as at point 22, which at that point includes only the rich stream from DCSS 312 (see above).

The leaner liquid fraction stream from gravity separator S-6, having parameters as at point 170, enters into circulating pump P-8, where its pressure is increased and it obtains parameters as at point 171. Thereafter the leaner liquid fraction stream, having parameters as at point 171, is divided into two substreams. One of those substreams passes through heat exchanger HE-16, where it is heated by heat released in the condensing process 45–207 (see above), and obtains parameters as at point 71. The other substream, having parameters as at point 46, is mixed with the oncoming working stream, in vapor form and having parameters as at point 143, resulting in the oncoming working stream having the parameters as at point 144 (see above). The stream of liquid, having parameters as at point 71, is divided into two substreams having parameters as at points 82 and 83. The stream, with parameters as at point 83, may be added to a stream with parameters as at point 87 (see above). The stream, with parameters as at point 82, passes through boiler HE-34, where it is heated and fully vaporized by heat from the furnace and obtains parameters as at point 186. The stream of vapor, having parameters as at point 186, is mixed with the oncoming working stream, also in vapor form and having parameters as at point 80, resulting in the oncoming working stream having parameters as at point 63 (see above).

The remainder expanded gaseous stream, with parameters as at point 311 (see above), enters into reheater HE-32, where it is heated by the heat from the furnace and obtains parameters as at point 35. Thereafter this stream of vapor passes through the intermediate pressure turbine (IPT) where it is further expanded, producing power and a further expanded stream having the parameters as at point 145. The further expanded stream, having parameters as at point 145, passes through second reheater HE-33 where it is heated again by heat from the furnace, obtaining parameters as at point 146. The stream, having parameters as at point 146, passes through a low pressure turbine (LPT), where it is further expanded, producing power and obtaining parameters as at point 36. The stream of vapor, having parameters as at point 36, is referred to as the spent stream. It passes through heat exchanger HE-14, where it is cooled, providing heat for process 81–188 and obtaining parameters as at point 33. Then the spent stream, having parameters as at point 33, is divided into two substreams. One substream passes through heat exchanger HE-19, where it is further cooled, providing heat for process 42–43 and obtaining parameters as at point 205. The other substream passes through heat exchanger HE-18, where it is cooled, providing heat for process 144–148 and obtaining parameters as at point 149. Then the substream, having parameters as at point 149, passes through heat exchanger HE-24, where it is further cooled, providing heat for process 71–142 and obtaining parameters as at point 206. The substreams having parameters as at points 205 and 206 are then combined, resulting in the spent stream having parameters as at point 37. The spent stream, still in vapor form and having parameters as at point 37, is then divided into two substreams. One of these substreams passes through heat exchanger HE-22, where it is cooled, providing heat for process 41–42 (see above) and obtaining parameters as at point 201. The other substream passes through heat exchanger HE-21, where it is cooled, providing heat for process 196–198 (see above) and obtaining parameters as at point 202. Then the substreams having parameters as at points 201 and 202 are combined, resulting in the spent stream having parameters as at point 38. The spent stream with parameters as at point 38 is then sent into DCSS 312. The process is closed.

As one can see from this description, the extracted stream, with parameters as at point 31, is first cooled with the recuperation of heat and thereafter mixed with a preheated stream of a lean portion of the working fluid, having parameters as at point 44, creating the combined extracted/lean stream with parameters as at point 45. This mixing reduces the composition of the extracted stream, making it leaner and causing it to condense in a temperature range high enough to heat the on-coming stream of the rich portion of the working fluid with initial parameters as at point 22. Moreover, the temperature of heat released in the process of condensation of the combined extracted/lean stream, with initial parameters as at point 45, is even unnecessarily high for the initial heating of a stream of rich composition with initial parameters as at point 22. For this reason it is possible that after partially condensing the combined extracted/lean stream, with initial parameters as at point 45, to separate this stream into a liquid, with parameters as at point 170, and enriched liquid vapor mixture, with parameters as at point 68, and then fully condense this enriched mixture, providing heat for initial heating of a portion of a working fluid with enriched composition having parameters as at point 22. Because this initial heating is performed by a condensing of the enriched stream, it is then possible to pump this enriched and fully condensed stream to a high pressure in pump P-7 and mix it with the on-coming rich stream having parameters as at point 22. Because the extracted stream is added to the oncoming working stream and returned in a loop to the high pressure turbine, there is less rejection of heat to outside of the system and improved efficiency. The rich stream is converted into a vapor at high pressure by recuperation of heat released in condensation of the extracted stream. Also, part of the combined extracted/lean stream is heated, after its complete condensation, recuperatively, by using heat released in the process of condensation of the same stream. Also, an enriched portion is separated from the combined extracted/lean stream and is mixed with the rich portion of the on-coming stream from DCSS 312.

Other Embodiments

Other embodiments of the invention are within the scope of the claims. E.g., It is possible to have just one reheat or two stages of the turbine with no reheat at all or a single turbine stage.

Figure 3:
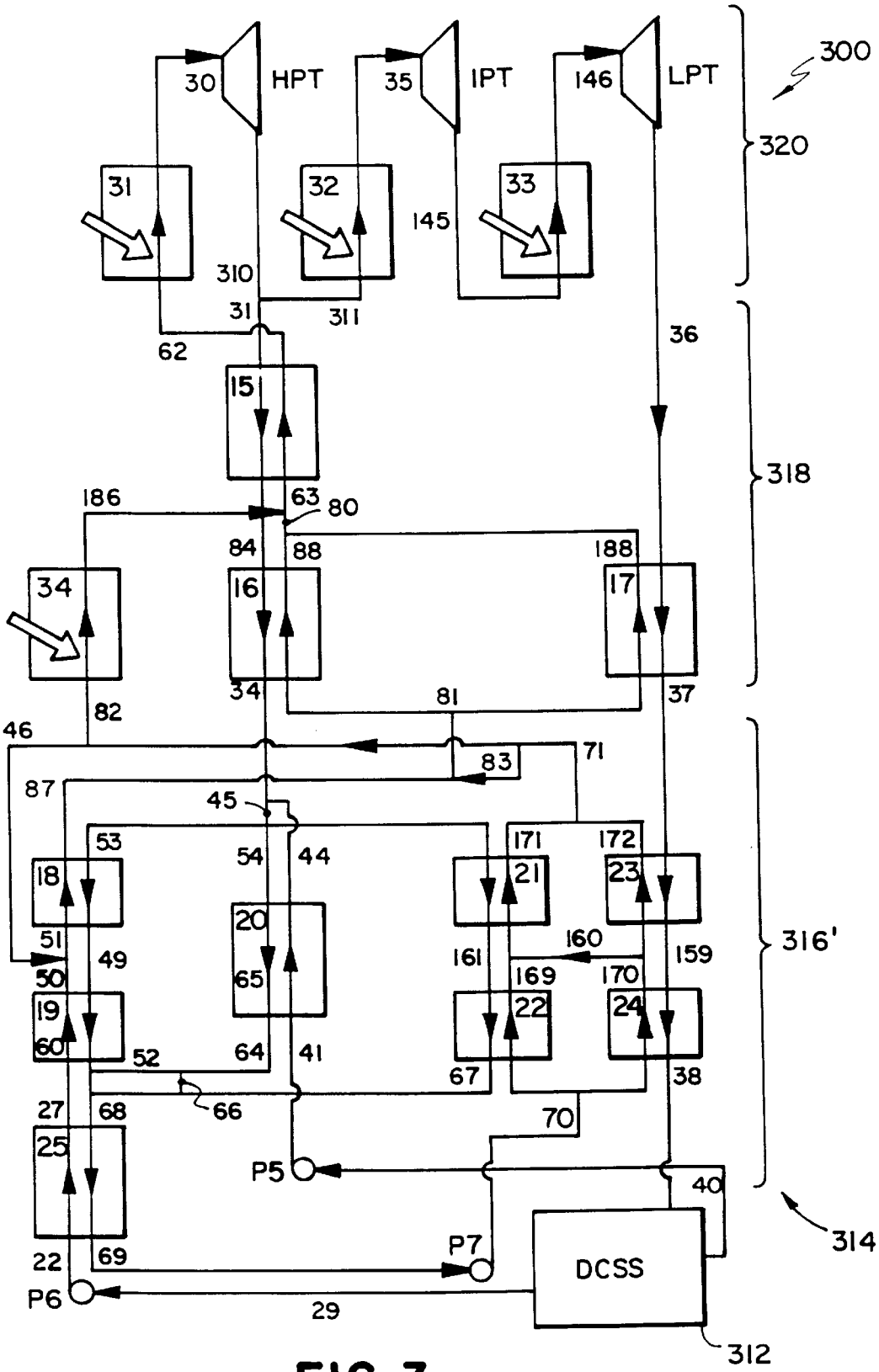
FIG. 3 is a diagram of an alternative embodiment of apparatus for implementing a thermodynamic cycle.

FIG. 3 shows an alternative simplified arrangement for boiling condensing heat recuperation subsystem, designated 316' in FIG. 3. This version of the system has the same DCSS 312, furnace boiling and vapor heat recuperation subsystem 318, and superheating heat acquisition and turbine expansion subsystem 320. As in the FIG. 2 embodiment, DCSS 312 produces a lean stream and a rich stream with parameters as at points 40 and 29, respectively. Thereafter, the oncoming working stream with parameters as at point 29 is pumped by feed pump P6 to a high pressure and obtains parameters as at point 22 (identical to the FIG. 2 embodiment). The lean stream, with parameters as at point 40, is pumped by circulating pump P5 to an intermediate pressure and obtains parameters as at point 41 (identical to the FIG. 2 embodiment). Thereafter, the lean stream with parameters as at point 41 enters into heat exchanger HE-20, where it is heated by a descending substream of the combined extracted/lean stream (see below), obtaining parameters as at point 44. The extracted stream, in vapor form and having parameters as at point 34, enters boiling condensing heat recuperation subsystem 316 and is mixed with the lean stream, having parameters as at point 44, creating the combined extracted/lean stream with parameters as at point 45 (identical to the FIG. 2 embodiment above). Thereafter, the combined extracted/lean stream with parameters as at point 45, is divided into three substreams. One of those substreams, with parameters as at point 54, passes through heat exchanger HE-20, where it is fully condensed and subcooled, providing heat for process 41–44 and obtaining parameters as at point 64. Another substream, with parameters as at point 53, passes through heat exchanger HE-18, where it is partially condensed, releasing heat and obtains parameters as at point 49. Thereafter, the substream with parameters as at point 49 passes through heat exchanger HE-19, where it is fully condensed and subcooled, releasing heat and obtaining parameters as at point 52. Then the substreams, with parameters as at points 64 and 52, are mixed, creating a stream with parameters as at point 66. The third substream, into which a stream with initial parameters as at point 45 has been divided, passes through heat exchanger HE-21, where it is partially condensed, releasing heat and obtaining parameters as at point 161. Then the substream, with parameters as at point 161, passes through heat exchanger HE-22, where it is fully condensed and subcooled, obtaining parameters as at point 67. Then the substream, with parameters as at point 67, is mixed with the stream with parameters as at point 66, resulting in a combined extracted/lean stream creating having parameters as at point 68. Thereafter, the combined extracted/lean stream with parameters as at point 68 passes through heat exchanger HE-25, where it is further cooled, releasing heat and obtaining parameters as at point 69. Heat released in process 68–69 is used to heat the oncoming working stream (initially including only the rich stream), with initial parameters as at point 22, which passes through heat exchanger HE-25 and obtains parameters as at point 27. The combined extracted/lean stream, in the form of a condensed and subcooled liquid and having parameters as at point 69, is pumped by circulating pump P7 to a high pressure and obtains parameters as at point 70. The spent stream of low pressure vapor, with parameters as at point 37, enters the boiling condensing heat recuperation subsystem 316, passing through heat exchanger HE-23, where it is cooled, releasing heat and obtaining parameters as at point 159. Thereafter, the spent stream with parameters as at point 159, passes through heat exchanger HE-24, where it is further cooled, releasing heat and obtaining parameters as at point 38. Then the spent stream, with parameters as at point 38, enters DCSS 312 (identical to the FIG. 1 embodiment described above). The combined extracted/lean stream, in liquid form and having parameters as at point 70, is divided into two substreams, which pass through heat exchangers HE-22 and HE-24, where they are heated and obtain parameters as at points 169 and 170, correspondingly. Then the stream, with parameters as at point 170, is divided into two substreams. One of those substreams, with parameters as at point 160, is mixed with the stream having parameters as at point 169, and then the resulting new stream passes through heat exchanger HE-21, where it is heated and obtains parameters as at point 171. Another substream, into which the stream with parameters as at point 170 was divided, passes through heat exchanger HE-23, where it is heated and obtains parameters as at point 172. Thereafter, streams with parameters as at points 171 and 172 are combined, resulting in the combined extracted/lean stream having parameters as at point 71. The combined extracted/lean stream with parameters as at point 71 is in a state of saturated liquid or slightly subcooled. Then the combined extracted/lean stream, with parameters as at point 71, is divided into two substreams with parameters as at points 82 and 46, correspondingly. The stream, with parameters as at point 82, then enters into the furnace boiling and vapor heat recuperation subsystem 318 (identical to the system of the FIG. 2 embodiment described above).

The oncoming working stream of rich liquid, with parameters as at point 27 (see above), passes through heat exchanger HE-19, where it is heated by heat released in process 49–52 and converted into superheated vapor having parameters as at point 50. Thereafter, the oncoming working stream with parameters as at point 50, is mixed with the combined extracted/lean stream, in the form of a liquid and having parameters as at point 46, resulting in the oncoming working stream having parameters as at point 51, which is in a state of vapor-liquid mixture. This mixing of the streams, having parameters as at point 50 and 46, is performed in such a way that the temperature of the resulting oncoming working stream having parameters as at point 51 is equal or very close to the temperature of the oncoming stream having parameters as at point 50. Thereafter, the oncoming working stream with parameters as at point 51 passes through heat exchanger HE-18, where it is heated and fully vaporized and obtains parameters as at point 87. Then the oncoming working stream, with parameters as at point 87, could be mixed with a small portion of the combined extracted/lean stream having parameters as at point 71 to alter its composition. This small portion of the stream, added to the stream having parameters as at point 87, has parameters as at point 83. After mixing, the resulting oncoming working stream has parameters as at point 81, which usually corresponds to a state of saturated vapor. Thereafter, the oncoming working stream with parameters as at point 81 (identical to the FIG. 2 embodiment described above) is sent into the furnace boiling and vapor heat recuperation subsystem 318.

Thus, this simplified variant of the proposed system differs from the FIG. 2 embodiment by a different arrangement of the boiling condensing heat recuperating subsystem 316. In this simplified boiling condensing heat recuperating subsystem 316, the combined extracted/lean stream is not separated into rich and lean portions as it was in separator S6 in the FIG. 2 described above.

The parameters of the key points of DCSS 312 in both the FIG. 2 and FIG. 3 embodiments are identical and are presented on Table 1. The parameters of the key points of all the rest of the FIG. 2 embodiment are presented on Table 2. The parameters of the key points of the rest of the FIG. 3 embodiment are presented on Table 3.

The FIG. 2 system has an efficiency of a power cycle equal to 48.65% and efficiency of the whole system, including boiler losses and auxiliaries, equal to 44.08%. The FIG. 3 system, with the simplified boiling condensing heat recuperating subsystem 316', has an efficiency of a power cycle equal to 48.29%, and the overall efficiency of the system, including boiler losses and auxiliaries, is equal to 43.8%. As one can see, the FIG. 3 system with the simplified boiling condensing heat recuperating subsystem 316 has a lower efficiency then the FIG. 2 system. One experienced in art can add to the proposed system a topping Rankine Cycle (e.g., as described in U.S. Pat. No. 4,899,545 and, in such a case, its efficiency may be raised up to over 45%. The described systems do not require a distillation tower, promoting economics and simplicity.

TABLE 1

| # | P pisa | X | T ° F. | H BTU/lb | G/G30 | Flow lb/hr | Phase |
|---|---|---|---|---|---|---|---|
| 1 | 35.70 | .5095 | 62.00 | −73.21 | 2.6743 | 751,257 | SatLiquid |
| 2 | 84.85 | .5095 | 62.09 | −73.01 | 1.1948 | 335,633 | Liq 47° |
| 3 | 82.85 | .5095 | 107.66 | −24.25 | 1.0587 | 297,410 | SatLiquid |
| 4 | 104.42 | .4992 | 124.45 | −6.46 | 1.5101 | 424,223 | SatLiquid |
| 5 | 101.42 | .4992 | 149.18 | 115.29 | 1.5101 | 424,223 | Wet .8406 |
| 6 | 101.42 | .9504 | 175.96 | 643.78 | .4870 | 136,817 | Wet .0025 |
| 7 | 108.42 | .4992 | 62.53 | −72.83 | 1.5101 | 424,223 | Liq 64° |
| 8 | 84.85 | .5095 | 62.09 | −73.01 | .1361 | 38,223 | Liq 47° |
| 9 | 108.42 | .4992 | 62.53 | −72.83 | .0000 | 0 | Liq 64° |
| 10 | 101.42 | .2844 | 194.65 | 85.91 | 1.0231 | 287,406 | SatLiquid |
| 11 | 101.42 | .2844 | 194.65 | 85.91 | 1.0231 | 287,406 | SatLiquid |
| 12 | 101.42 | .2844 | 132.34 | 20.27 | 1.0231 | 287,406 | Liq 62° |
| 13 | 100.82 | .8800 | 74.26 | 267.57 | .7759 | 217,975 | Wet.5023 |
| 14 | 100.52 | .8800 | 62.00 | −4.34 | .7759 | 217,975 | SatLiquid |
| 15 | 36.00 | .5413 | 99.20 | 138.39 | 1.7990 | 505,381 | Wet .7303 |
| 16 | 36.60 | .8800 | 132.45 | 561.47 | .7759 | 217,975 | Wet .1102 |
| 17 | 36.60 | .5413 | 132.45 | 253.69 | 1.7990 | 505,381 | Wet .6162 |
| 18 | 36.00 | .5046 | 91.75 | 70.54 | 2.6743 | 751,257 | Wet .8232 |
| 19 | 36.60 | .2844 | 132.45 | 20.27 | 1.0231 | 287,406 | SatLiquid |
| 21 | 488.64 | .8800 | 63.24 | −2.35 | .7759 | 217,975 | Liq 107° |
| 23 | ° | Water | 55.00 | 23.00 | 40.4368 | 11,359,472 | |
| 58 | ° | Water | 64.44 | 32.44 | 22.3424 | 6,276,418 | |
| 59 | ° | Water | 82.27 | 50.27 | 14.0967 | 3,960,034 | |
| 99 | ° | Water | 78.21 | 46.21 | 3.9977 | 1,123,020 | |
| 24 | ° | Water | 72.02 | 40.02 | 40.4368 | 11,359,472 | |
| 28 | 486.64 | .8800 | 107.66 | 46.75 | .7759 | 217,975 | Liq 63° |
| 29 | 482.64 | .8800 | 147.18 | 92.03 | .7759 | 217,975 | Liq 22° |
| 38 | 36.90 | .7150 | 198.81 | 783.33 | 1.0000 | 280,919 | SatVapor |
| 40 | 36.90 | .1436 | 191.81 | 116.09 | .2241 | 62,944 | SatLiquid |

TABLE 1-continued

| # | P pisa | X | T ° F. | H BTU/lb | G/G30 | Flow lb/hr | Phase |
|---|---|---|---|---|---|---|---|
| 72 | 108.42 | .7613 | 62.03 | −35.79 | .2889 | 81,158 | Liq 16° |
| 73 | 80.85 | .7613 | 104.32 | 285.22 | .2889 | 81,158 | Wet .4895 |
| 74 | 80.70 | .7613 | 62.00 | −35.92 | .2889 | 81,158 | SatLiquid |
| 75 | 108.42 | .7613 | 62.03 | −35.79 | .2889 | 81,158 | Liq 16° |
| 76 | 108.42 | .7613 | 62.03 | −35.79 | .2889 | 81,158 | Liq 16° |
| 77 | 36.30 | .5413 | 111.66 | 182.32 | 1.7990 | 505,381 | Wet .6855 |
| 105 | 80.85 | .5095 | 128.45 | 84.53 | 1.0587 | 297,410 | Wet .8556 |
| 106 | 80.85 | .9854 | 128.45 | 604.12 | .1528 | 42,935 | SatVapor |
| 107 | 80.85 | .4292 | 128.45 | −3.13 | .9059 | 254,475 | SatLiquid |
| 108 | 80.85 | .4292 | 111.66 | −21.10 | .9059 | 254,475 | Liq 17° |
| 109 | 80.85 | .4292 | 66.48 | −68.91 | .9059 | 254,475 | Liq 62° |
| 110 | 36.00 | .4292 | 66.58 | −68.91 | .8753 | 245,876 | Liq 17° |
| 111 | 35.70 | .4292 | 66.58 | −68.91 | .0306 | 8,599 | Liq 16° |
| 112 | 108.42 | .4992 | 62.53 | −72.83 | 1.5101 | 424,223 | Liq 64° |
| 113 | 108.42 | .4992 | 62.53 | −72.83 | 1.5101 | 424,223 | Liq 64° |
| 114 | 106.42 | .4992 | 107.66 | −24.58 | 1.5101 | 424,223 | Liq 18° |
| 115 | 108.42 | .7613 | 62.03 | −35.79 | .0000 | 0 | Liq 16° |
| 116 | 101.27 | .9504 | 128.45 | 552.43 | .4870 | 136,817 | Wet .0771 |
| 117 | 101.12 | .9504 | 111.66 | 525.76 | .4870 | 136,817 | Wet .0998 |
| 118 | 100.82 | .9504 | 76.12 | 447.53 | .4870 | 136,817 | Wet .1947 |
| 119 | 484.64 | .8800 | 122.41 | 63.49 | .7759 | 217,975 | Liq 47° |
| 120 | 106.42 | .4992 | 107.66 | −24.58 | .0000 | 0 | Liq 18° |
| 121 | 106.42 | .4992 | 107.66 | −24.58 | .8977 | 252,185 | Liq 18° |
| 122 | 106.42 | .4992 | 107.66 | −24.58 | .6124 | 172,038 | Liq 18° |
| 123 | 104.42 | .4992 | 124.45 | −6.46 | .0000 | 0 | SatLiquid |
| 124 | 104.42 | .4992 | 124.45 | −6.46 | .8977 | 252,185 | SatLiquid |
| 125 | 104.42 | .4992 | 124.45 | −6.46 | .6124 | 172,038 | SatLiquid |
| 126 | 36.30 | .5413 | 132.13 | 253.69 | .1855 | 52,115 | Wet .6159 |
| 127 | 36.30 | .5413 | 111.66 | 182.32 | 1.6135 | 453,266 | Wet .6855 |
| 128 | 36.00 | .5413 | 74.52 | 34.58 | .1855 | 52,115 | Wet .8496 |
| 129 | 36.00 | .5413 | 102.40 | 150.32 | 1.6135 | 453,266 | Wet .7178 |
| 130 | 101.42 | .4992 | 171.96 | 201.67 | .1074 | 30,167 | Wet .745 |
| 131 | 101.42 | .4992 | 139.22 | 73.26 | .8424 | 236,660 | Wet .8916 |
| 132 | 101.42 | .4992 | 161.13 | 161.92 | .5603 | 157,396 | Wet .7881 |
| 133 | 35.70 | .4992 | 62.41 | −73.12 | 1.5101 | 424,223 | Liq 2° |
| 135 | 100.82 | .9504 | 76.12 | 447.53 | .0000 | 0 | Wet .1947 |
| 136 | 80.85 | .9854 | 128.45 | 604.12 | .1528 | 42,935 | SatVapor |
| 138 | 36.75 | .8800 | 165.13 | 683.05 | .7759 | 217,975 | SatVapor |
| 139 | 482.64 | .8800 | 147.18 | 92.03 | .7759 | 217,975 | Liq 22° |
| 150 | 36.75 | .2028 | 165.13 | 73.11 | .2479 | 69,640 | SatLiquid |
| 151 | 39.90 | .2028 | 165.20 | 73.12 | .2479 | 69,640 | Liq 5° |
| 152 | 36.75 | .7160 | 165.13 | 535.36 | 1.0238 | 287,615 | Wet .2421 |
| 153 | 36.75 | .7160 | 163.92 | 529.61 | .8981 | 252,280 | Wet .2475 |
| 154 | 36.75 | .7160 | 173.20 | 576.46 | .1258 | 35,335 | Wet .2032 |
| 155 | 36.90 | .2028 | 191.81 | 177.78 | .2479 | 69,640 | Wet .9038 |
| 156 | 36.90 | .7590 | 191.81 | 757.72 | .0238 | 6,696 | SatVapor |
| 157 | 36.90 | .7160 | 198.65 | 782.74 | 1.0238 | 287,615 | SatVapor |
| 158 | 100.82 | .9504 | 76.12 | 447.53 | .4870 | 136,817 | Wet .1947 |
| 165 | 101.42 | .4084 | 149.18 | 20.16 | 1.2694 | 356,601 | SatLiquid |
| 166 | 101.42 | .9780 | 149.18 | 616.95 | .2407 | 67,622 | SatVapor |
| 174 | 104.42 | .4084 | 149.16 | 20.17 | 1.2694 | 356,601 | Liq 2° |
| 175 | 101.42 | .4084 | 194.65 | 199.25 | 1.2694 | 356,601 | Wet .806 |
| 176 | 101.42 | .9235 | 194.65 | 669.99 | .2463 | 69,195 | SatVapor |

TABLE 2

| # | P pisa | X | T ° F. | H BTU/lb | G/G30 | Flow lb/hr | Phase |
|---|---|---|---|---|---|---|---|
| 22 | 2492.50 | .8800 | 156.48 | 103.26 | .7759 | 215,450 | Liq 188° |
| 27 | 2492.50 | .8731 | 192.44 | 142.39 | 1.1833 | 328,568 | Liq 156° |
| 29 | 482.76 | .8800 | 147.19 | 92.05 | .7759 | 215,450 | Liq 22° |
| 30 | 2415.00 | .7150 | 1231.00 | 1410.23 | 2.1454 | 595,698 | Vap 769° |
| 31 | 1070.00 | .7150 | 1045.09 | 1279.87 | 1.1454 | 318,032 | Vap 629° |
| 33 | 38.91 | .7150 | 425.38 | 905.90 | 1.0000 | 277,666 | Vap 224° |
| 34 | 1068.00 | .7150 | 425.38 | 834.35 | 1.1454 | 318,032 | Vap 9° |
| 35 | 1040.00 | .7150 | 1231.00 | 1415.54 | 1.0000 | 277,666 | Vap 817° |
| 36 | 39.91 | .7150 | 831.43 | 1148.27 | 1.0000 | 277,666 | Vap 629° |
| 37 | 37.91 | .7150 | 314.67 | 845.24 | 1.0000 | 277,666 | Vap 115° |
| 38 | 36.91 | .7150 | 198.82 | 783.34 | 1.0000 | 277,666 | SatVapor |
| 41 | 1075.50 | .1436 | 193.25 | 119.94 | .2241 | 62,216 | Liq 288° |
| 42 | 1070.50 | .1436 | 302.67 | 234.41 | .2241 | 62,216 | Liq 178° |
| 44 | 1068.00 | .1436 | 413.38 | 357.27 | .2241 | 62,216 | Liq 67° |
| 45 | 1068.00 | .6215 | 422.38 | 756.29 | 1.3694 | 380,247 | Wet .1716 |
| 46 | 2490.00 | .5205 | 329.39 | 235.84 | .3124 | 86,753 | Liq 118° |

TABLE 2-continued

| # | P pisa | X | T ° F. | H BTU/lb | G/G30 | Flow lb/hr | Phase |
|---|---|---|---|---|---|---|---|
| 49 | 1066.00 | .6215 | 386.14 | 586.81 | 1.1342 | 314,921 | Wet .3946 |
| 50 | 2490.00 | .8731 | 302.67 | 311.23 | 1.1833 | 328,568 | Liq 46° |
| 62 | 2450.00 | .7150 | 783.44 | 1058.31 | 2.1454 | 595,698 | Vap 322° |
| 63 | 2460.00 | .7150 | 684.92 | 977.21 | 2.1454 | 595,698 | Vap 223° |
| 64 | 1064.00 | .5205 | 321.86 | 228.62 | .0547 | 15,180 | SatLiquid |
| 65 | 1064.00 | .6215 | 321.86 | 341.79 | 1.3694 | 380,247 | Wet .7424 |
| 66 | 1064.00 | .9126 | 321.86 | 668.01 | .3527 | 97,937 | SatVapor |
| 67 | 1064.00 | .5205 | 321.86 | 228.62 | 1.0167 | 282,310 | SatLiquid |
| 68 | 1064.00 | .8600 | 321.86 | 609.05 | .4074 | 113,117 | Wet .1342 |
| 69 | 1060.00 | .8600 | 242.95 | 207.61 | .4074 | 113,117 | SatLiquid |
| 70 | 2492.50 | .8600 | 253.29 | 216.92 | .4074 | 113,117 | Liq 102° |
| 71 | 2470.00 | .5205 | 413.38 | 369.99 | .6496 | 180,377 | Liq 33° |
| 80 | 2460.00 | .7995 | 778.59 | 1025.73 | 1.4958 | 415,321 | Vap 365° |
| 81 | 2470.00 | .7995 | 413.38 | 638.87 | 1.4958 | 415,321 | SatVapor |
| 82 | 2470.00 | .5205 | 413.38 | 369.99 | .6496 | 180,377 | Liq 33° |
| 83 | 2470.00 | .5205 | 413.38 | 369.99 | .0000 | 0 | Liq 33° |
| 84 | 1069.00 | .7150 | 831.43 | 1127.95 | 1.1454 | 318,032 | Vap 415° |
| 87 | 2470.00 | .7995 | 413.38 | 638.87 | 1.4958 | 415,321 | SatVapor |
| 88 | 2460.00 | .7995 | 778.59 | 1025.73 | .8693 | 241,365 | Vap 365° |
| 141 | 2480.00 | .8731 | 82.11 | 574.08 | 1.0967 | 304,521 | Vap 34° |
| 142 | 2480.00 | .8731 | 382.11 | 574.08 | .0866 | 24,047 | Vap 34° |
| 143 | 2480.00 | .8731 | 382.11 | 574.08 | 1.1833 | 328,568 | Vap 34° |
| 144 | 2480.00 | .7995 | 382.13 | 503.43 | 1.4958 | 415,321 | Wet .4661 |
| 145 | 259.50 | .7150 | 904.20 | 1191.92 | 1.0000 | 277,666 | Vap 592° |
| 146 | 229.50 | .7150 | 1231.00 | 1416.28 | 1.0000 | 277,666 | Vap 927° |
| 159 | 37.42 | .7150 | 279.67 | 826.45 | 1.0000 | 277,666 | Vap 80° |
| 160 | 1072.86 | .1436 | 272.67 | 202.49 | .2241 | 62,216 | Liq 208° |
| 161 | 1060.23 | .8600 | 279.67 | 470.89 | .4074 | 113,117 | Wet .3352 |
| 162 | 2491.18 | .8731 | 272.67 | 253.84 | 1.1833 | 328,568 | Liq 76° |
| 170 | 1064.00 | .5205 | 321.86 | 228.62 | .9621 | 267,130 | SatLiquid |
| 171 | 2490.00 | .5205 | 329.39 | 235.84 | .9621 | 267,130 | Liq 118° |
| 173 | 2470.00 | .5205 | 413.38 | 369.99 | .0000 | 0 | Liq 33° |
| 186 | 2460.00 | .5205 | 530.12 | 865.48 | .6496 | 180,377 | SatVapor |
| 188 | 2460.00 | .7995 | 778.59 | 1025.73 | .6265 | 173,955 | Vap 365° |
| 196 | 2492.50 | .8748 | 183.82 | 132.79 | .2021 | 56,113 | Liq 164° |
| 197 | 2492.50 | .8728 | 194.20 | 144.37 | .9812 | 272,455 | Liq 154° |
| 198 | 2490.00 | .8748 | 302.67 | 312.18 | .2021 | 56,113 | Liq 45° |
| 199 | 2490.00 | .8728 | 302.67 | 311.04 | .9812 | 272,455 | Liq 46° |
| 201 | 36.91 | .7150 | 198.82 | 783.34 | .4144 | 115,052 | SatVapor |
| 202 | 36.91 | .7150 | 198.82 | 783.34 | .5856 | 162,614 | SatVapor |
| 205 | 37.91 | .7150 | 314.67 | 845.24 | .4538 | 126,009 | Vap 115° |
| 206 | 37.91 | .7150 | 314.67 | 845.24 | .5462 | 151,657 | Vap 115° |
| 207 | 1064.00 | .6215 | 333.39 | 385.91 | .2353 | 65,327 | Wet .6719 |
| 208 | 1064.00 | .6215 | 319.45 | 332.64 | 1.1342 | 314,921 | Wet .7577 |

TABLE 3

| # | P pisa | X | T ° F. | H BTU/lb | G/G30 | Flow lb/hr | Phase |
|---|---|---|---|---|---|---|---|
| 22 | 2492.50 | .8800 | 156.66 | 103.47 | .7759 | 217,975 | Liq 188 |
| 27 | 2490.00 | .8800 | 195.81 | 148.38 | .7759 | 217,975 | Liq 149 |
| 29 | 482.64 | .8800 | 147.18 | 92.03 | .7759 | 217,975 | Liq 22 |
| 30 | 2415.00 | .7150 | 1231.00 | 410.23 | 2.0666 | 580,544 | Vap 769 |
| 31 | 1125.25 | .7150 | 1056.36 | 287.48 | 1.0666 | 299,625 | Vap 636 |
| 33 | 38.90 | .7150 | 511.87 | 954.87 | 1.0000 | 280,919 | Vap 311 |
| 34 | 1123.25 | .7150 | 419.73 | 824.69 | 1.0666 | 299,625 | SatVapor |
| 35 | 1095.25 | .7150 | 1231.00 | 415.42 | 1.0000 | 280,919 | Vap 813 |
| 36 | 39.90 | .7150 | 827.52 | 1145.79 | 1.0000 | 280,919 | Vap 625 |
| 37 | 37.90 | .7150 | 417.06 | 901.33 | 1.0000 | 280,919 | Vap 217 |
| 38 | 36.90 | .7150 | 198.81 | 783.33 | 1.0000 | 280,919 | SatVapor |
| 40 | 36.90 | .1436 | 191.81 | 116.09 | .2241 | 62,944 | SatLiquid |
| 41 | 1130.75 | .1436 | 193.39 | 120.22 | .2241 | 62,944 | Liq 294 |
| 44 | 1123.25 | .1436 | 410.06 | 353.42 | .2241 | 62,944 | Liq 77 |
| 45 | 1123.25 | .6158 | 425.26 | 742.88 | 1.2907 | 362,569 | Wet .1951 |
| 46 | 2470.00 | .6158 | 410.06 | 435.06 | .3174 | 89,168 | SatLiquid |
| 49 | 1121.25 | .6158 | 398.39 | 616.35 | .6835 | 192,006 | Wet .3641 |
| 50 | 2480.00 | .8800 | 391.09 | 599.70 | .7759 | 217,975 | Vap 47 |
| 51 | 2480.00 | .8033 | 391.09 | 551.90 | 1.0933 | 307,143 | Wet .1722 |
| 52 | 1119.25 | .6158 | 211.42 | 104.00 | .6835 | 192,006 | Liq 84 |
| 53 | 1123.25 | .6158 | 425.26 | 742.88 | .6835 | 192,006 | Wet .1951 |
| 54 | 1123.25 | .6158 | 425.26 | 742.88 | .0797 | 22,399 | Wet .1951 |
| 60 | 2480.00 | .8800 | 344.39 | 429.36 | .7759 | 217,975 | Vap 0 |
| 61 | 2470.00 | .8800 | 410.06 | 638.90 | .7759 | 217,975 | Vap 66 |
| 62 | 2450.00 | .7150 | 815.25 | 1083.77 | 2.0666 | 580,544 | Vap 353 |

TABLE 3-continued

| # | P pisa | X | T ° F. | H BTU/lb | G/G30 | Flow lb/hr | Phase |
|---|---|---|---|---|---|---|---|
| 63 | 2460.00 | .7150 | 496.25 | 790.95 | 2.0666 | 580,544 | Vap 34 |
| 64 | 1119.25 | .6158 | 197.39 | 87.52 | .0797 | 22,399 | Liq 98 |
| 65 | 1121.25 | .6158 | 295.61 | 215.64 | 1.2907 | 362,569 | SatLiquid |
| 66 | 1119.25 | .6158 | 209.97 | 102.28 | .7632 | 214,404 | Liq 85 |
| 67 | 1119.25 | .6158 | 184.76 | 73.06 | .5274 | 148,165 | Liq 111 |
| 68 | 1119.25 | .6158 | 199.81 | 90.34 | 1.2907 | 362,569 | Liq 96 |
| 69 | 1115.25 | .6158 | 176.21 | 63.34 | 1.2907 | 362,569 | Liq 119 |
| 70 | 2490.00 | .6158 | 180.76 | 69.92 | 1.2907 | 362,569 | Liq 231 |
| 71 | 2470.00 | .6158 | 410.06 | 435.06 | 1.2907 | 362,569 | SatLiquid |
| 80 | 2460.00 | .8033 | 499.87 | 775.33 | 1.0933 | 307,143 | Vap 89 |
| 81 | 2470.00 | .8033 | 410.06 | 631.00 | 1.0933 | 307,143 | SatVapor |
| 82 | 2470.00 | .6158 | 410.06 | 435.06 | .9732 | 273,402 | SatLiquid |
| 83 | 2470.00 | .6158 | 410.06 | 435.06 | .0000 | 0 | SatLiquid |
| 84 | 1124.25 | .7150 | 511.87 | 899.13 | 1.0666 | 299,625 | Vap 92 |
| 85 | 2450.00 | .7150 | 824.07 | 1090.79 | 1.3814 | 388,073 | Vap 362 |
| 86 | 2450.00 | .7150 | 797.52 | 1069.60 | .6851 | 192,471 | Vap 336 |
| 87 | 2470.00 | .8033 | 410.06 | 631.00 | 1.0933 | 307,143 | SatVapor |
| 88 | 2460.00 | .8033 | 499.87 | 775.33 | .5501 | 154,522 | Vap 89 |
| 89 | 2460.00 | .8033 | 499.87 | 775.33 | .1723 | 48,411 | Vap 89 |
| 145 | 264.00 | .7150 | 896.73 | 1186.92 | 1.0000 | 280,919 | Vap 583 |
| 146 | 234.00 | .7150 | 1231.00 | 1416.28 | 1.0000 | 280,919 | Vap 926 |
| 159 | 37.40 | .7150 | 343.53 | 860.92 | 1.0000 | 280,919 | Vap 144 |
| 160 | 2480.00 | .6158 | 291.01 | 204.95 | .3990 | 112,101 | Liq 126 |
| 161 | 1122.25 | .6158 | 305.01 | 256.38 | .5274 | 148,165 | Wet .9152 |
| 169 | 2480.00 | .6158 | 291.01 | 204.95 | .7160 | 201,146 | Liq 120 |
| 170 | 2480.00 | .6158 | 291.01 | 204.95 | .5746 | 161,423 | Liq 120 |
| 171 | 2470.00 | .6158 | 410.06 | 435.06 | 1.1151 | 313,247 | SatLiquid |
| 172 | 2470.00 | .6158 | 410.06 | 435.06 | .1756 | 49,322 | SatLiquid |
| 180 | 2470.00 | .8033 | 410.06 | 631.00 | .1723 | 48,411 | SatVapor |
| 186 | 2460.00 | .6158 | 499.87 | 808.50 | .9732 | 273,402 | SatVapor |
| 188 | 2460.00 | .8033 | 499.87 | 775.33 | .3710 | 104,210 | Vap 89 |

What is claimed is:

1. A method of implementing a thermodynamic cycle comprising expanding a gaseous working stream to transform its energy into a useful form and produce an expanded gaseous stream, removing from the expanded gaseous stream an extracted stream and producing a remainder expanded gaseous stream, absorbing the extracted stream into a lean stream having a higher content of a higher-boiling component than is contained in the extracted stream to form a combined extracted/lean stream, at least partially condensing the combined extracted/lean stream, adding at least part of the combined extracted/lean stream in condensed form to an oncoming working stream including a rich stream having a lower content of the higher-boiling component than is contained in the extracted stream, and recuperatively heating said oncoming working stream after said adding using heat released in the process of said at least partially condensing the combined extracted/lean stream, said oncoming working stream after said recuperative heating becoming said gaseous working stream.

2. The method of claim 1 further comprising heating said oncoming working stream, after said recuperatively heating, using external heat to provide said gaseous working stream.

3. The method of claim 1 further comprising pumping said at least part of the combined extracted/lean stream in condensed form to an elevated pressure prior to said adding.

4. The method of claim 1 wherein said at least part of the combined extracted/lean stream in condensed form is heated to a vapor state by external heat prior to said adding to said oncoming working stream, which also is in a vapor state.

5. The method of claim 1 wherein said at least part of the combined extracted/lean stream in condensed form and said oncoming working stream are in liquid states when added.

6. The method of claim 1 wherein said adding includes adding a first part of said combined extracted/lean stream after said at least partially condensing to said oncoming working stream when both are in liquid states, and thereafter adding a second part of said combined extracted/lean stream after said at least partially condensing to said oncoming working stream when said oncoming working stream is in a vapor state and after said second part has been externally heated to a vapor state.

7. The method of claim 1 further comprising heating and thereafter further expanding said remainder expanded gaseous stream to transform its energy into a useful form and produce a further expanded stream.

8. The method of claim 7 further comprising heating and thereafter further expanding said further expanded stream to transform its energy into a useful form and produce a spent stream.

9. The method of claim 8 further comprising producing said lean stream and said rich stream from said spent stream.

10. The method of claim 1 wherein said extracted stream is cooled before said absorbing by transferring heat to said oncoming working stream prior to said heating said oncoming working stream with external heat.

11. The method of claim 1 wherein said combined extracted/lean stream after said at least partially condensing is separated into a leaner liquid fraction and a richer vapor-liquid fraction before said adding.

12. The method of claim 11 wherein said richer vapor-liquid fraction is condensed by transferring heat to said oncoming working stream to produce a condensed richer fraction, and said adding includes adding said condensed richer fraction to said oncoming working stream prior to said transferring heat.

13. The method of claim 12 wherein said adding further includes adding part of said leaner liquid fraction to said oncoming working stream as a liquid, and converting part of said leaner liquid fraction by heating with external heat to a vapor and adding it to said oncoming working stream as a vapor.

14. The method of claim 11 wherein said at least partially condensing said combined extracted/lean stream includes cooling said combined extracted/lean stream by transferring heat to at least part of said leaner liquid fraction.

15. The method of claim 11 wherein said adding includes adding part of said leaner liquid fraction to said oncoming working stream as a liquid, and thereafter converting said oncoming stream to a vapor by transferring heat from said combined extracted/lean stream.

16. The method of claim 1 further comprising transferring heat from said remainder expanded gaseous stream to said oncoming working stream and said lean stream.

17. The method of claim 16 further comprising transferring heat from said extracted stream to said oncoming working stream.

18. A method of implementing a thermodynamic cycle comprising the steps of expanding a working stream in gaseous form at a high pressure to transform its energy into a useful form and produce an expanded gaseous stream, further expanding at least part of said expanded gaseous stream at a lower pressure to transform its energy into a useful form and produce a spent stream, separating from said spent stream a lean stream having a higher content of higher-boiling component than is contained in said spent stream and producing a remainder spent stream, adding a first makeup stream to said remainder spent stream to produce a combined makeup/remainder spent stream, condensing said combined makeup/spent stream to produce a condensed remainder spent stream, and separating said condensed remainder spent stream into a rich stream and said first makeup stream, said rich stream having a lower content of higher-boiling component than is contained in said spent stream, said makeup stream having a higher content of higher-boiling component than said rich stream.

19. The method of claim 18, wherein said separating from said spent stream includes partially condensing said spent stream into liquid and vapor components and separating said liquid component from said vapor component, said vapor component being said remainder spent stream.

20. The method of claim 19 wherein said separating from said spent stream further includes partially boiling said liquid component and separating it into said lean stream in liquid form and a vapor stream that is added to said spent stream prior to said partially condensing.

21. The method of claim 18 wherein said separating said condensed remainder stream also includes extracting a second makeup stream from said condensed remainder stream and further comprising adding said second makeup stream to said combined makeup/remainder stream.

22. The method of claim 21 wherein said separating said condensed remainder stream includes splitting said condensed remainder stream into first and second streams and recuperatively heating said first stream to partially boil it and thereafter separating a liquid component from said first stream, said liquid component being said second makeup stream.

23. The method of claim 22 wherein said separating said condensed remainder stream includes adding a vapor component separated from said first stream to said second stream, recuperatively heating said second stream to partially boil it, thereafter separating a second stream liquid component from said second stream, and providing said first makeup stream from said second stream liquid component.

24. The method of claim 23 wherein said providing includes recuperatively heating said second stream liquid component to partially boil it, and thereafter separating a further liquid component from said second stream liquid component, said further liquid component being said first makeup stream.

25. The method of claim 24 wherein vapors separated from said second stream liquid component and said further liquid component are combined to provide said rich stream.

26. An apparatus for implementing a thermodynamic cycle comprising a turbine for expanding a gaseous working stream to transform its energy into a useful form and produce an expanded gaseous stream, a separator that is connected to receive said expanded gaseous stream and remove from the expanded gaseous stream an extracted stream and a remainder expanded gaseous stream, an absorber that receives said extracted stream and a lean stream having a higher content of higher-boiling component than is contained in the extracted stream and forms a combined extracted/lean stream, one or more heat exchangers in which the combined extracted/lean stream is at least partially condensed, and a stream combiner at which at least part of the combined extracted/lean stream from said one or more heat exchangers is added to an oncoming working stream including a rich stream having a lower content of higher-boiling component than is contained in the extracted stream, said oncoming working stream from said stream combiner being recuperatively heated in at least one of said one or more heat exchangers and being used to provide said gaseous working stream.

27. The apparatus of claim 26 further comprising a heat exchanger that heats said oncoming working stream with external heat after it has been recuperatively heated.

28. An apparatus for implementing a thermodynamic cycle comprising a high pressure turbine for expanding a working stream in gaseous form to transform its energy into a useful form and produce an expanded gaseous stream, a lower pressure turbine for expanding at least part of said expanded gaseous stream to transform its energy into a useful form and produce a spent stream, a first separator that is connected to receive said spent stream and remove from said spent stream a lean stream having a higher content of higher-boiling component than is contained in said spent stream and a remainder spent stream, a stream combiner at which a first makeup stream is added to said remainder spent stream to produce a combined makeup/remainder spent stream, a condenser at which said combined makeup/spent stream is condensed to produce a condensed remainder spent stream, and a second separator that separates said condensed remainder spent stream into a rich stream and said first makeup stream, said rich stream having a lower content of higher-boiling component than is contained in said spent stream, said makeup stream having a higher content of higher-boiling component than said rich stream.

* * * * *